US008225718B2

(12) United States Patent
Joys et al.

(10) Patent No.: US 8,225,718 B2
(45) Date of Patent: Jul. 24, 2012

(54) LEAD FREE FRANGIBLE BULLETS

(75) Inventors: Jessu Joys, Holland, PA (US); Barry Anshutz, Sterling, OH (US); K. Clive Ramsey, Bernardsville, NJ (US)

(73) Assignee: United States Metal Powders Incorporated, Flemington, NJ (US)

( * ) Notice: Subject to any disclaimer, the term of this patent is extended or adjusted under 35 U.S.C. 154(b) by 177 days.

(21) Appl. No.: 12/575,750

(22) Filed: Oct. 8, 2009

(65) Prior Publication Data

US 2010/0083861 A1 Apr. 8, 2010

Related U.S. Application Data

(60) Provisional application No. 61/103,657, filed on Oct. 8, 2008.

(51) Int. Cl.
*F42B 12/22* (2006.01)

(52) U.S. Cl. ..... 102/506; 102/517

(58) Field of Classification Search ..... 102/506, 102/517

See application file for complete search history.

(56) References Cited

U.S. PATENT DOCUMENTS

| | | | | |
|---|---|---|---|---|
| 5,722,035 | A * | 2/1998 | Matysik et al. | 419/28 |
| 6,074,454 | A | 6/2000 | Abrams et al. | |
| 6,090,178 | A | 7/2000 | Benini et al. | |
| 6,263,798 | B1 * | 7/2001 | Benini | 102/430 |
| 6,536,352 | B1 | 3/2003 | Nadkarni et al. | |
| 6,694,888 | B2 | 2/2004 | Jopson et al. | |
| 7,143,679 | B2 | 12/2006 | Yaich | |
| 7,322,297 | B2 | 1/2008 | Yaich | |
| 2002/0005137 | A1 * | 1/2002 | Stone | 102/517 |

OTHER PUBLICATIONS

Corbin. <http://web.archive.org/web/20061129214410/http://www.corbins.com/powder.htm>. Nov. 29, 2006.*

Corbin Chem. <http://web.archive.org/web/20061108210723/http://www.corbins.com/chemical.htm>. Nov. 8, 2006.*

* cited by examiner

*Primary Examiner* — Gabriel Klein

(74) *Attorney, Agent, or Firm* — Norris McLaughlin & Marcus, P.A.

(57) ABSTRACT

A lead-free, frangible bullet is provided. The lead-free, frangible bullet is manufactured without sintering or external heating of the bullet. The bullet is prepared by blending a lead-free copper powder mixture and cold compacting the powder in a die to form a bullet. The copper powder can be atomized copper powder, electrolytic copper powder, or a combination of atomized and electrolytic copper powder. The atomized copper powder can be water atomized, air atomized, and combination of water and air atomized. Preferably, the frangible bullet has a fragmentation less than 5 grains.

3 Claims, 4 Drawing Sheets

LEAD FREE FRANGIBLE BULLETS

CROSS-REFERENCE TO RELATED APPLICATIONS

This patent application claims benefit to U.S. provisional patent application No. 61/103,657, filed Oct. 8, 2008, of the same title, the entire disclosure of which is incorporated herein by reference.

BACKGROUND OF THE INVENTION

1. Field of the Invention

The present invention relates to bullets. More particularly, the present invention relates to lead free frangible bullets.

2. Description of Related Art

Lead has long been used as a component in bullets and ammunition because of its high density. Because of its toxicity however, bullets that are free of lead are strongly preferred both from an environmental standpoint and for health reasons. In many instances lead free bullets are required by governmental regulations.

Frangible bullets are bullets that break up into small, less harmful, pieces upon contact with anything harder than the bullet (hereinafter reference to bullet includes any projectile or ammunition unless otherwise noted). This maximizes the round's transfer of energy to the object and minimizes the chances that pieces of the bullet will exit the object at dangerous velocities. Each of the small fragments quickly loses energy and therefore poses very little danger to any secondary targets. This means that full-power frangible bullets can be shot at target all the way up to muzzle contact while greatly reducing the risk that the bullet or case will ricochet and potentially hurt either the shooter or others.

Frangible bullets come in a variety of configurations, all of which perform in the same basic manner. Some, like the well-publicized Glaser Safety Slug, are hollow point rounds that are filled with tiny metal beads. Others are simply solid rounds with grooves or notches intended to facilitate rapid expansion and breakup.

Frangible bullets have been designed for a number of applications. For example, frangible bullets are used in training exercises to reduce lead hazards on firing ranges. Frangible bullets are especially suitable for marksmanship training for indoor and outdoor ranges, tactical team training, close-in engagement of metal targets and specialized service use. It is generally considered the safest full-power training ammo for police and military shooters, civilian range owners and casual shooters. Frangible lead free bullets are useful in indoor shooting ranges, and reduce any potential problems resulting from airborne lead dust, as well as reducing costly environmental cleanup.

In addition, recent events, particularly the hijacking of airplanes by terrorists, have raised the possibility of armed air marshals on scheduled airline flights to intervene in the event of an attempted hijacking. Another proposal is to arm pilots with weapons capable of selectively and accurately dispensing lethal force against a hijacker. A serious disadvantage with either of these options is the risk associated with discharging a conventional weapon on an airplane. The danger posed by a conventional weapon includes the bullet passing through the hijacker and striking another person or piercing the fuselage with concomitant loss of air pressure within the plane.

It would be desirable to have a lead-free bullet that is frangible. It would be desirable to have a lead free bullet that has a high degree of frangibility with no ricochet. It would be desirable to have a lead free, frangible bullet with a degree of frangibility with no particle greater than 5 grains. It would be desirable to have lead-free frangible bullet that does not require sintering or other metal additives to achieve the required strength and frangibility.

SUMMARY OF THE INVENTION

A lead-free, frangible bullet is provided. The lead-free, frangible bullet is manufactured without sintering or external heating of the bullet. The bullet is prepared by blending a lead-free copper powder or lead-free copper powder mixture, and cold compacting the powder or mixture in a die to form a bullet. The copper powder can be atomized copper powder, electrolytic copper powder, or a combination of atomized and electrolytic copper powder. The atomized copper powder can be water atomized, air atomized, and combination of water and air atomized. Preferably, the frangible bullet has a fragmentation less than 5 grains.

In one embodiment, the composition of the copper powder is about 20% to 60% atomized copper and the remainder electrolytic copper. Further, the lead free mixture may include one or more additional ingredients such as a lubricant, a phenolic resin, up to 30% of additional non-copper metal powders or alloyed powders, such as tin and ceramic material.

Other aspects of the invention will be apparent to those of ordinary skill in the art in view of the disclosure provided herein.

DESCRIPTION OF THE INVENTION

Figure 1:
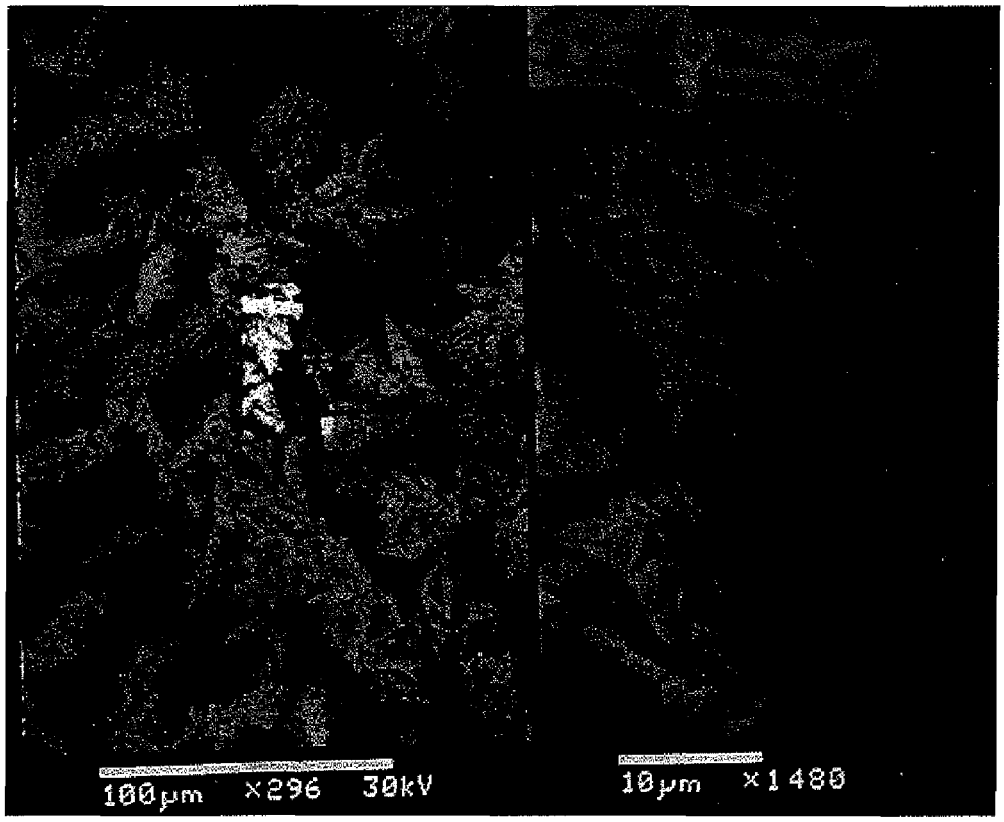
FIG. 1 is a scanning electron micrograph of electrolytic copper powder.

A frangible bullet and method of manufacturing frangible bullets is provided. There are different degrees of frangibility in the ammunition industry. Different users of frangible ammunition may prefer different degrees of frangibility depending on the specific intended use of the bullet. In some instances it is preferable to have complete breakup into powder to eliminate any ricochet or back-splatter and minimum penetration of the steel backstop. Other instances require retention of base pieces sufficiently large to preserve the rifling marks to assist in identifying the weapon which fired the bullet. Still others may prefer breakup into small pieces rather than powder to minimize airborne particles, and at the same time also minimize the ricochet potential.

The following description describes frangible bullets and methods of manufacture directed primarily to bullets with a high degree of frangibility. However, the invention is not so limited and the methods described herein could easily be adapted to manufacture bullets with various levels of frangibility simply by adjusting the copper powder mixture and/or the pressure of the cold compacting.

One important feature of the bullets and methods provided by the invention is that they are not sintered. The method of the invention provides bullets of sufficient strength and frangibility without sintering the bullets. The term "non-sintered" for the purposes of this applications means that the bullet or projectile is not sintered or heated during the manufacturing process. During cold compacting, the bullet may rise in temperature due to the compacting process itself. Not heated in this context means that the bullet is not subjected to some external heat source during the manufacturing process (separate and apart from the possible temperature rise from the compacting process).

In one embodiment of the invention, frangible bullets are manufactured from copper powder by first blending the powder, and then cold compacting the powder in a die at a sufficient pressure to produce a bullet. The bullets are compacted using a typical die set and compacting press. Optionally, a relatively nominal amount of a suitable lubricant is included in the powder to keep the bullet from sticking to the die. The amount of pressure used varies but is at a level to produce a bullet with a green strength sufficient to permit handling of the part without chipping but not so high that the bullet will not have the intended level of frangibility.

Copper powder typically contains some small level of impurities but is preferably over 99% pure. No additional metals or other additives are required, and the presence or absence of impurities does not significantly affect the resulting bullet. In contrast to conventional techniques, the frangible bullets need not be sintered or heated in order to produce a frangible bullet of sufficient strength. The bullets obtain the appropriate strength and frangibility characteristics from the type of copper powder used, as discussed below in more detail.

In one embodiment, the copper powder is pressed to a density between about 7.1 to about 8.5 g/cm$^3$ which produce bullets with acceptable firing characteristics and high level of frangibility. Preferably, the density is about 7.8 g/cm$^3$.

Alternatively, the copper powder is pressed to form a bullet with a specific strength and frangibility. Tests have shown that frangibility can be predicted as a function of Break psi. Preferably, the bullets are compacted to a strength that does not exceed transverse rupture strength of about 20,000 PSI in order to have good frangibility.

In one embodiment, the copper powder is either atomized copper powder, electrolytic copper powder, or a mixture of both atomized copper powder and electrolytic copper powder. The type of atomized copper that can be used is air atomized copper and water atomized copper, or a combination of both.

Figure 2:
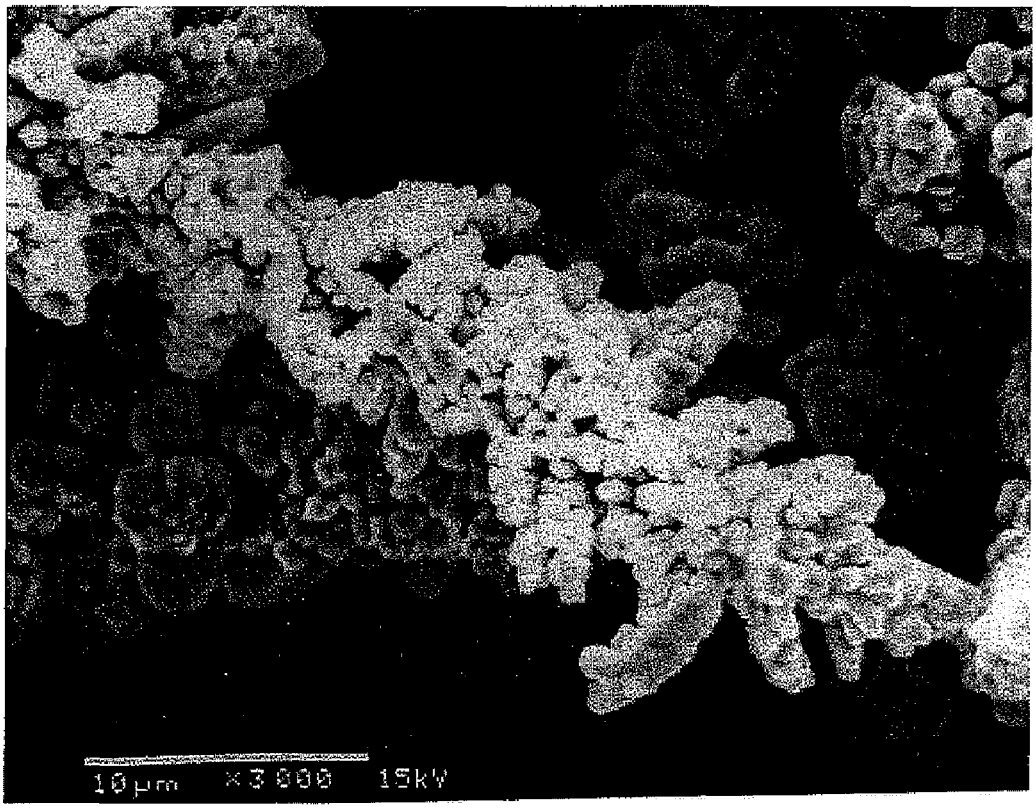
FIG. 2 is a scanning electron micrograph of electrolytic copper powder at a greater magnification than FIG. 1.

Electrolytic copper powder is also known as dendritic copper powder because of the shape of the copper crystals. FIGS. 1 and 2 show scanning electron micrographs of electrolytic copper powder at different magnifications. FIG. 1 shows two pictures of the same powder. The left picture shows the powder magnified to 296 times (×296) and the right picture shows the copper particles further magnified at a magnification of 1480 times (×1480). FIG. 2 is magnified to "3000 times" (×3000). Electrolytic or dendritic copper powder is manufactured by the electrolytic deposition method known to those skilled in the art. Electrolytic copper powder is typically produced by an electroplating method. Loose copper that is deposited on the electrodes are separated, washed and annealed in a reducing atmosphere. Next the copper is then screened, and classified to powder. In one embodiment, the electrolytic copper powder used has an apparent density ranging from about 0.9 to about 1.5 and mostly finer particles (70-90% particles are <45 microns).

The irregular shape of the electrolytic copper powder allows the powder to be cold pressed into a bullet of sufficient strength without the need of sintering or the inclusion of other metals. In one embodiment, frangible bullets are manufactured from primarily or entirely electrolytic copper powder. Alternatively, the frangible bullets can manufactured using water atomized copper only.

Figure 3:
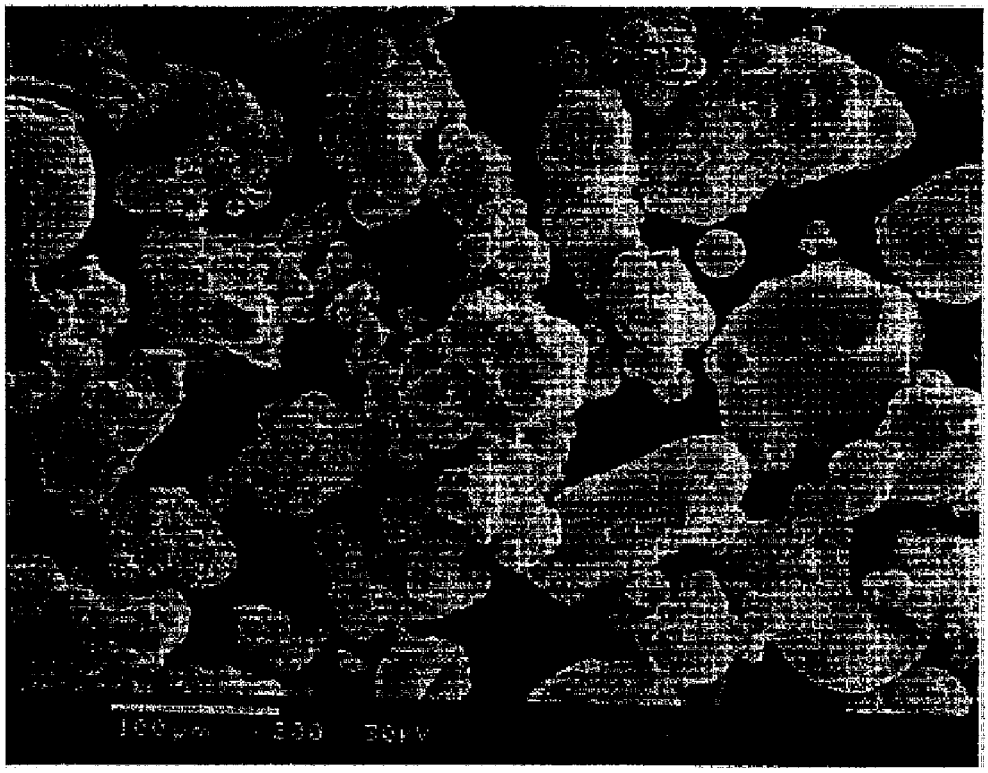
FIG. 3 is a scanning electron micrograph of water atomized copper powder.
Figure 4:
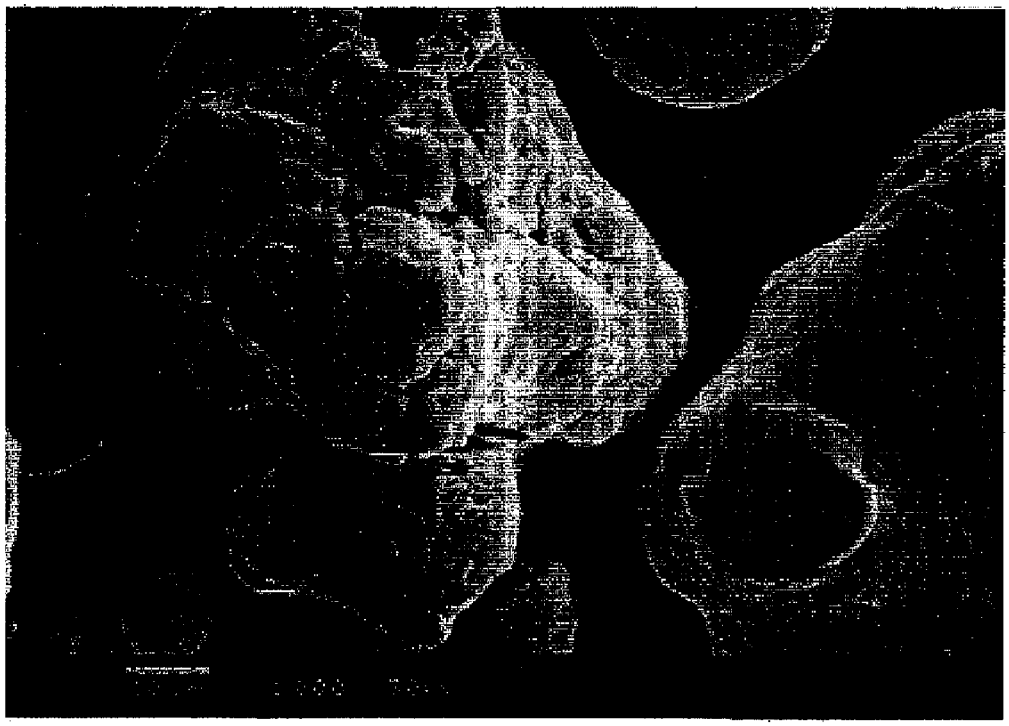
FIG. 4 is a scanning electron micrograph of water atomized copper powder at a greater magnification than FIG. 3.

Preferably however, the frangible bullets are manufactured using a mixture of both electrolytic copper powder and atomized copper. In such a mixture, the atomized copper can be air atomized copper, water atomized copper, or a mixture of both. Atomized copper powder can be produced by air or water atomization. In the air atomization process, a molten liquid stream of copper powder is sprayed through a nozzle/orifice. After exiting the nozzle, the liquid is struck by compressed air at high pressure. The liquid breaks up in to particles as it exits the nozzle and is instantaneously cooled by ambient temperature. In water atomization high pressure water jets are used in place of Air. The atomized copper, because of its shape, is important in the manufacture of the bullet by, while the electrolytic copper powder contributes the strength of the cold pressed bullet. FIGS. 3 and 4 show scanning electron micrographs of water atomized copper powder at different magnifications. FIG. 3 is magnified to "200 times" (×200) and FIG. 4 is magnified to "1000 times" (×1000). As can be seen the water atomized copper powder has a different, less irregular shape than that of the electrolytic powder shown in FIGS. 1 and 2.

The mixture of copper powder can be in any proportion of electrolytic copper powder and atomized copper powder. Preferably, the proportion of electrolytic copper powder to atomized copper powder is about 20% to 60%. More preferably the proportion is about 30% electrolytic copper powder and the remainder atomized copper powder. However, frangible bullets can be obtained with a wide range of different mixture proportions.

The exact proportion of atomized copper powder and electrolytic copper powder depends on a number of factors including the desired level of frangibility and the coarseness or fineness of the powder, and the type of atomized powder. For example, the combination of minus 100 mesh electrolytic copper powder and minus 60 mesh water atomized powder combined at a ratio of about 50% each works well to produce frangible bullets with no particles greater than 5 grains. Other combinations will work and those that are skilled in the art will be readily able to produce bullets of various frangibility levels using various combinations of electrolytic and atomized copper powder.

One advantage of adding atomized powder to the blend is that it improves the free flow of the final blend. In the typical manufacturing process of the frangible bullets the copper/copper based powder is kept in a container (hopper/drums/bags) at a height above the compacting press where the powder is drained from the bottom of the container to the frangible bullet die. To facilitate the process, this powder should free flow from the container to the compacting die and fill the die easily and uniformly. Electrolytic powder, because of its dendritic shape, does not flow well by itself. Both the air atomized powder and the water atomized powder flow very well. Because of the spherical shape the air atomized powder has the best free flowing properties. Accordingly the addition of atomized powder helps the flow of the powder.

In one embodiment a relatively small amount of lubricant is added to the copper powder prior to being pressed in the die. The addition of lubricant prevents the bullet from getting stuck in the press when the bullet is ejected from the press. The lubricant can also increase the strength of the resulting bullet. Lubricants, however, need not be included. This is particularly true when the die used does not have much friction because it is equipped with "die wall lubrication" by means of coating the die walls with enough lubrication.

In another embodiment, phenolic resin is added to the copper powder. A relatively small amount of phenolic resin will increase the strength of the bullet, but not so much that the resulting bullet loses its frangibility. The phenolic resin is added to the powder prior to the cold compacting of the bullet in an amount from about 0.1 to about 5 wt %. The phenolic resin can be added to the copper powder with lubricants or without lubricants. Preferably, from about 0.5-1.5% of lubricant is added to the blend of copper grades (mix of electrolytic copper powder and atomized copper powder).

In an alternate embodiment, bullets are prepared using the atomized and electrolytic copper powder and techniques described above but contain up to about 30% of other metal powders or alloyed powders. The additional metal powder may be any suitable metal or alloy powder and include for example zinc, tin, bismuth, phosphorous, aluminum, iron, magnesium, chromium, cobalt, titanium, silicone, metal oxides, ceramic materials or combinations of two or more of these.

For example the composition can include a number of additional ingredients in addition to the copper such as a mixture tin, ceramic material (Mullite powder) and lubricant. Mullite powder is an aluminum silicate that is derived from Alumina ($Al_2O_3$) and Silica.

EXAMPLES

Aspects of the present teachings can be further understood in light of the following examples, which should not be construed as limiting the scope of the present teachings in any way. In the following examples, the blend composition is given by weight percent.

Example 1

The following blend was prepared in a double cone blender: 59.9% Copper powder grade "Cu275" (Cu275 is a standard water atomized copper produced by United States Metal Powder, Inc.), 40% electrolytic copper powder (40%), and 0.45% of a lubricant primarily consisting of a Lithium complex and stearic wax (0.45%). Both the Cu275 powder grade and electrolytic copper powder grades were—100 mesh (average particle size <150 microns). The electrolytic copper powder used is a standard powder grade. All the ingredients were put into the double-cone blender and blended for 30 minutes. Transverse rupture strength bars were prepared using Tinius Olsen Universal Testing machine. The following test results were obtained:

Compacting pressure=50 TSI
Green density=7.8 g/cc
Transverse rupture strength=9500 PSI Example 1 illustrates that the transverse rupture strength of 9500 PSI is acquired by cold compacting without exposing the parts to heat or sintering.

Example 2

A sample was prepared according to Example 1 except that the following blend was used: Copper powder grade "Cu275" (produced by United States Metal Powder, Inc.) (75%), electrolytic copper powder (23.5%), and acrawax lubricant (1.5%). The following test results were obtained at compacting pressures of 40 TSI and 50 TSI:

Compacting pressure=40 TSI
Green density=7.22 g/cc
Transverse rupture strength=4800 PSI
Compacting pressure=50 TSI
Green density=7.9 g/cc
Transverse rupture strength=7700 PSI

Example 3

A sample was prepared according to Example 1 except that the following blend was used: Copper powder grade "Cu275" (produced by United States Metal Powder, Inc.) (50%), electrolytic copper powder (49.5%), a lubricant that mainly comprised of Lithium complex and stearic wax (0.5%). The following test results were obtained at compacting pressures of 50 TSI:

Compacting pressure=50 TSI
Green density=8.0 g/cc
Transverse rupture strength=8200 PSI

Example 4

A sample was prepared according to Example 1 except that the following blend was used: Copper powder grade "Cu275" (produced by United States Metal Powder, Inc.) (77%), electrolytic copper powder (8.5%), Tin powder (10%), phenolic resin (3%) and lubricant acrawax (1.5%). The tin powder used is a standard grade with an average particle size 44 microns. The phenolic resin is durite 2700 series from Hexion Speciality Chemicals, Inc. The average particle size was <88 microns. The following test results were obtained at compacting pressures of 50 TSI:

Compacting pressure=50 TSI
Green density=7.1 g/cc
Transverse rupture strength=6000 PSI

Example 5

A sample was prepared according to Example 1 except that the following blend was used: Copper powder grade "Cu275" (produced by United States Metal Powder, Inc.) (75%), electrolytic copper powder (5%), Brass alloy powder (produced by United States Metal Powder, Inc.) (15%) and acrawax lubricant (1.5%). The brass powder is an alloy of 96.5% copper and 3.5% zinc. The following test results were obtained at compacting pressures of 40 TSI:

Compacting pressure=40 TSI
Green density=7.22 g/cc
Transverse rupture strength=4800 PSI

Example 6

A sample was prepared according to Example 1 except that the following blend was used: Copper powder grade "Cu275" (produced by United States Metal Powder, Inc.) (75%), electrolytic copper powder (15%), Tin powder (9.5%), and 0.5% of Molybednum Sulfide powder as lubricant. The Tin powder and the Molybednum Sulfide powder we used was a standard grade of with average particle size <44 microns. The following test results were obtained at compacting pressures of 40 TSI and 50 TSI:

Compacting pressure=40 TSI
Green density=7.94 g/cc
Transverse rupture strength=9000 PSI
Compacting pressure=50 TSI
Green density=8.19 g/cc
Transverse rupture strength=10,500 PSI

Example 7

A sample was prepared according to Example 1 except that the following blend was used: 90% Copper powder grade "Cu275" (produced by United States Metal Powder, Inc.) 4% electrolytic copper powder, 1.1% of mullite powder, 4.3% of tin powder and 0.6% of a lubricant primarily consisting of a Lithium complex and stearic wax (0.45%). Both the Cu275 powder grade and electrolytic copper powder grades were—100 mesh (average particle size <150 microns and the tin powder was—200 mesh). The mullite powder used is a commercially available standard powder grade. All the ingredients were put into the double-cone blender and blended for 30 minutes. Transverse rupture strength bars were prepared using Tinius Olsen Universal Testing machine. The following test results were obtained:

Compacting pressure=57 TSI

Green density=7.9 g/cc

Transverse rupture strength=8300 PSI

The results of the Examples show that higher strength and green densities can be achieved by compacting at higher pressures.

In addition, crush tests were performed on bullets made in accordance with the invention (i.e. non-sintered) to measure the strength as compared with sintered bullets. 9 mm bullets were pressed and compressive crush strength of 1300 PSI was obtained for the non-sintered bullets at a green density of 7.9 g/cc. The non-sintered bullets were then compared to standard sintered/heated bronze bullets and the crush strength was also at 1300 PSI. Comparable strength was obtained from the sintered bullets and the non-sintered bullets.

In addition, tests were performed on bullets made in accordance with the invention (i.e. non-sintered) to measure the grain size upon impact. 40 Caliber flat nose non-sintered bullets were fired at steel at a velocity ranging from 1050 ft/sec to 1350 ft/sec. The bullets were successfully fired and the shattered particles upon impact were all less than 5 grains.

There will be various modifications, adjustments, and applications of the disclosed invention that will be apparent to those of skill in the art, and the present application is intended to cover such embodiments. Although the present invention has been described in the context of certain preferred embodiments, it is intended that the full scope of these be measured by reference to the scope of the following claims.

The disclosures of various publications, patents and patent applications that are cited herein are incorporated by reference in their entireties.

What is claimed is:

1. A lead-free, non-sintered frangible bullet consisting essentially of a copper powder composition of 20% to 60% atomized copper powder and the remainder electrolytic copper powder.

2. The frangible bullet of claim 1 wherein the atomized copper powder is chosen from the group of water atomized, air atomized, and a combination of water and air atomized.

3. The frangible bullet of claim 1 wherein the fragmentation of the bullet is less than 5 grains.

* * * * *